US006541903B1

(12) United States Patent
Kagabu et al.

(10) Patent No.: US 6,541,903 B1
(45) Date of Patent: Apr. 1, 2003

(54) CATHODE RAY TUBE AND METHOD FOR PUNCHED ELECTRODE PROFILE WITH PREDETERMINED ANGULAR RANGE

(75) Inventors: Ken Kagabu, Ichinomiya (JP); Takeshi Mera, Mobara (JP); Akihito Sudo, Mobara (JP)

(73) Assignees: Hitachi, Ltd., Tokyo (JP); Hitachi Electronic Devices Co., Ltd., Mobara (JP)

( * ) Notice: Subject to any disclaimer, the term of this patent is extended or adjusted under 35 U.S.C. 154(b) by 0 days.

(21) Appl. No.: 09/692,449

(22) Filed: Oct. 20, 2000

(30) Foreign Application Priority Data

Oct. 22, 1999 (JP) ..... 11-300502

(51) Int. Cl.[7] ..... H01J 29/70

(52) U.S. Cl. ..... 313/421; 313/426; 313/451; 445/29

(58) Field of Search ..... 313/421, 414, 313/417, 426, 427, 446, 448, 451; 445/46, 49

(56) References Cited

U.S. PATENT DOCUMENTS 4,366,414 A * 12/1982 Hatayama et al. ..... 313/409
4,975,618 A 12/1990 Koba et al. ..... 313/440
5,606,216 A 2/1997 Uchida et al. ..... 313/412
6,040,655 A * 3/2000 Mera et al. ..... 313/409

FOREIGN PATENT DOCUMENTS

JP 8-250025 9/1996
TW 266303 12/1995

* cited by examiner

*Primary Examiner*—Robert H. Kim
*Assistant Examiner*—Therese Barber
(74) *Attorney, Agent, or Firm*—Antonelli, Terry, Stout & Kraus, LLP

(57) ABSTRACT

The profile lines of plate-like grid electrodes are formed by a first punching step and separation lines of the plate-like grid electrodes are formed by a subsequent punching step. The angle of a crossing portion formed by the profile line and the separation line is set to not less than 70 degrees and not more than 110 degrees. Due to such a constitution, burrs on the plate-like grid electrode which constitutes an electron gun of a color cathode ray tube can be reduced so that the quality of the cathode ray tube can be enhanced and the manufacturing time of the cathode ray tube can be shortened.

6 Claims, 8 Drawing Sheets

CATHODE RAY TUBE AND METHOD FOR PUNCHED ELECTRODE PROFILE WITH PREDETERMINED ANGULAR RANGE

BACKGROUND OF THE INVENTION

1. Field of the Invention

The present invention relates to a cathode ray tube, and more particularly to a cathode ray tube characterized by plate-like grid electrodes constituting an electron gun thereof and a method for manufacturing the same.

2. Description of the Related Art

A color cathode ray tube used as a video tube or a monitor tube of an information terminal includes an electron gun irradiating a plurality (generally three) of electron beams at one end of an evacuated envelope. A phosphor screen coated with a phosphor layer made of a plurality of colors (generally three colors) is formed on an inner surface of the other end of the color cathode ray tube. A shadow mask which constitutes a color selection electrode is disposed close to the phosphor screen. By scanning a plurality of electron beams irradiated from the electron gun two-dimensionally by a magnetic field generated by a deflection yoke mounted on an outer portion of the evacuated envelope, given images can be displayed.

The above-mentioned electron gun further includes electron beam generating means which irradiates three electron beams (a so-called triode portion), focusing and accelerating means for focusing and accelerating these electron beams toward the phosphor screen, and a shield cup for shielding a leakage magnetic field from the deflection yoke at a final electrode side.

This type of electron gun is generally constituted by arranging a plurality of cylindrical grid electrodes and a plurality of plate-like grid electrodes in a tube axis direction. These plate-like grid electrodes are formed by punching a plate material having a thickness greater than a thickness of a material for forming the cylindrical grid electrodes using a press machine.

This type of punching of the plate-like grid electrode is comprised of the first step which sequentially punches out a large number of same kinds of electrodes which are connected as a group from a strip-like metal plate and the subsequent step which cuts and separates these electrodes as individual plate-like grid electrodes.

FIG. 10 is an explanatory view showing a state in which same kinds of plate-like grid electrodes are formed as a group by the first punching. Numeral 31 indicates individual plate-like grid electrodes. Each plate-like grid electrode 31 has an approximately rectangular planar shape with a curvature at corners thereof. The plate-like grid electrode 31 is provided with tabs 36 formed on a pair of one parallel sides of the rectangular shape. The tabs 36 are embedded into beading glass for fixing the plate-like grid electrode 31. Further, the plate-like grid electrode 31 is provided with three electron beam apertures 30*a*, 30*b*, 30*c* which are arranged in an in-line array along the longitudinal center line of the rectangular shape.

In the state that a first punching step is completed, connecting portions 33 are formed in a region adjacent to a pair of the other sides of the plate-like grid electrode 31. In a subsequent punching step, these connecting portions 33 are removed along a punching line 35 so as to cut and separate the electrodes formed as a group into individual unit electrodes. When the unit electrodes are cut and separated in the above-mentioned subsequent punching step, protruding portions 38 are formed on end portions of respective electrodes.

In the above-mentioned conventional punching, when the connecting portions 33 are punched out along the punching line 35, burrs are formed on end portions of the protruding portions 38.

FIG. 11 is an explanatory view showing a profile-line crossing angle made by a profile line formed by the conventional first punching step and a profile line formed by the conventional subsequent punching step. In the drawing, numeral 34 indicates the profile line punched by the first punching step and numeral 35 indicates a separation line punched by the subsequent punching step.

The connecting portions 33 which remain after the first punching step are separated along the separation lines 35 in the subsequent punching step. The separation lines 35 are indicated as curves bulged toward the connecting portion 33 side to be removed. On the other hand, the profile lines 34 are formed in the region of the connecting portion 33 such that they approach in the direction of an imaginary center line 301 of electron beam apertures having an in-line array and formed on the plate-like grid electrode. As a result, the crossing angle a made by the profile line 34 formed by the first punching step and the punching line, that is, the separation line 35 formed by the subsequent punching has becomes not less than 135 degrees as shown in the drawing.

Further, it has been thought that by making the crossing angle a as large as possible, the electric discharge in the inside of the color cathode ray tube can be suppressed. However, when the crossing angle a is increased, the burrs at the crossing portion become large and the electric discharge derived from the burrs is increased. Accordingly, a lot of time has been required for performing the barrel polishing.

FIG. 12A to FIG. 12C are partial views for explaining the states of the protruding portions of the plate-like grid electrode after removing the connecting portions by the above-mentioned subsequent punching. FIG. 12A is a plan view, FIG. 12B is a cross-sectional view taken along a line A—A of FIG. 12A and FIG. 12C is a side view of the electrode 31.

In this kind of punching, as shown in FIG. 11, when the punching is performed with the crossing angle a between the profile line 34 and the separation line 35 set to not less than 135 degrees, due to the frictional force generated between dies of the press working machine (a punch and a die), the material slips away toward the outside at the crossing portion of both lines. Due to such an action, the burrs 37 which extend in the planar direction of the electrode as shown in FIG. 12A are formed. Further, burrs 38 having an angle against the surface of the electrode as shown in FIG. 12B are formed in the punching cross-sectional direction. The burrs 38 are particularly large or outstanding in the vicinity of the crossing points as shown in FIG. 12C. Further, these burrs are liable to be formed at the time of forming electrodes having a thickness of not less than 0.5 mm.

When these burrs are present on the electrodess, in assembling the electrodes into an electron gun, the burrs become equal to or exceed the tolerance so that the assembling becomes impossible or it gives rise to the lowering of the assembling accuracy. Further, this brings about problems in terms of enhancing the quality of the color cathode ray tube including a following problem. That is, during the operation of the electron gun, the electric field is converged on these burrs so that a spark is generated resulting in the rupture of the electron gun or the rupture of the cathode ray tube.

Conventionally, these burrs are removed by a suitable polishing method such as the barrel polishing. However, on all of the products (plate-like grid electrodes) which are subjected to such a polishing, an inspection must be performed whether the burrs are sufficiently removed at a level necessary for allowing the assembling of these electrodes into the electron gun. This forms a bottleneck in the reduction of man-hours and has been one of the tasks to be solved for reducing the overall manufacturing cost of color cathode ray tubes. Further, the barrel polishing step requires a lot of time for removing burrs.

SUMMARY OF THE INVENTION

The present invention include an angle at a crossing portion which is made by a profile line formed by the first punching and a separation line formed by the subsequent punching to not less than 70 degrees and not more than 110 degrees.

The present invention is further constituted by a method of manufacturing color cathode ray tubes which includes a first punching step for forming profile lines in a state that a plurality of plate-like grid electrodes are connected by a connecting portion and a subsequent punching step for forming a cutting line which crosses the profile line at an angle of not less than 70 degrees and not more than 110 degrees.

By performing such a method, the slipping away of the material at the time of punching for removing connecting portions can be minimized and the generation of burrs can be reduced.

DETAILED DESCRIPTION OF THE PREFERRED EMBODIMENTS

Figure 1:
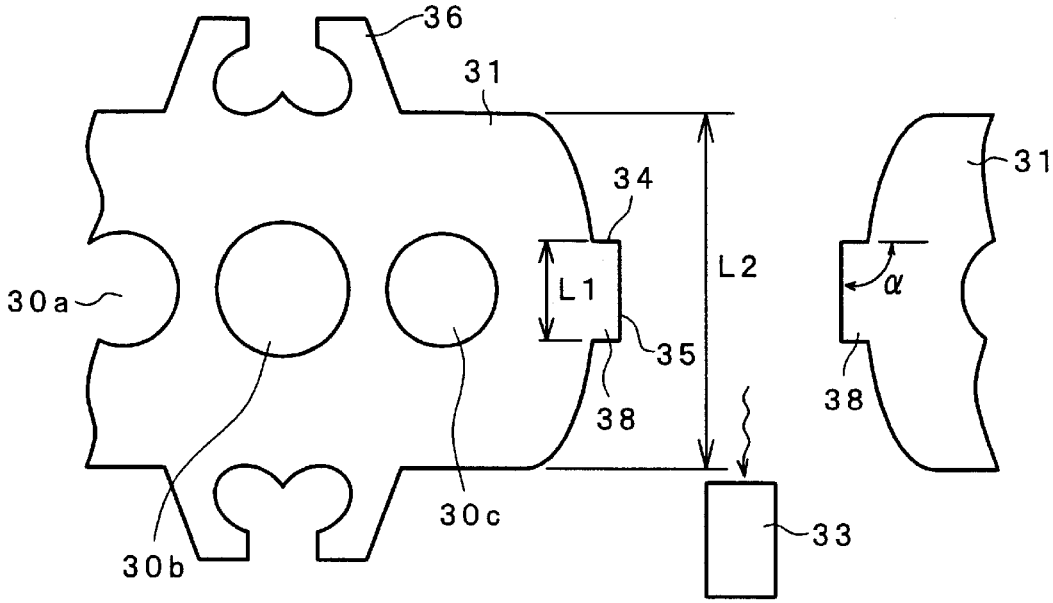
FIG. 1 is an explanatory view showing the first embodiment of the present invention, wherein a crossing angle between a connecting portion formed by the first punching and a punching line cut and separated by the subsequent punching is indicated.

To explain typical constitutions of the present invention, they are as follows.

(1): A cathode ray tube includes an evacuated envelope comprised of a panel portion forming a phosphor screen thereon, a neck portion housing an electron gun therein and a funnel-like funnel portion which connects the panel portion and the neck portion. The electron gun housed in the neck portion is constituted by a cathode, cylindrical grid electrodes and plate-like grid electrodes. These cathode and electrodes are arranged with a given positional relationship in a tube axis direction. The above-mentioned plate-like grid electrode has an approximately rectangular planar shape and is of a type which has tabs formed on a pair of one opposing sides thereof for fixedly securing the grid electrode by embedding the grid electrode in beading glass. Further, the grid electrode is formed into the state that a plurality of plate-like grid electrodes are connected by means of connecting portions by the first punching and the connecting portions disposed at a pair of the other opposing sides are removed by the subsequent punching. In protruding portions which are formed by removing the connecting portions, an exterior angle made by the first side formed by the first punching and a second side formed by a subsequent punching is set to not less than 90 degrees and not more than 110 degrees.

Since the neighboring two sides of the protruding portion cross at not less than 90 degrees, the slipping away of a material by punching at the time of forming the protruding portion by removing connecting portion becomes small so that the forming of burrs can be reduced.

(2): In the above-mentioned constitution (1), the plate-like grid electrode is provided with three electron beam apertures having the in-line array. The first sides of the protruding portion are made parallel to the in-line direction and the second side of the protruding portion is made perpendicular to the in-line direction.

(3): In the above-mentioned constitution (1), the plate-like grid electrode has three electron beam apertures arranged in the in-line array along a center line parallel to a pair of one sides of the plate-like grid electrodes. Further, the first sides of each protruding portion are formed of portions of circular arcs or elliptical arcs being recessed toward the above-mentioned a pair of one sides and the second side of each protruding portion is formed of a portion of a circular arc or an elliptical arc recessed toward the above-mentioned electron beam aperture.

The crossing angle spreads in a sector shape at an angle of not less than 90 degrees from a crossing point.

(4): In the above-mentioned constitution (1), the first sides of each protruding portion are formed of portions of circular arcs or elliptical arcs being recessed toward a pair of the above-mentioned one sides and the second side of each protruding portions is formed of a straight line parallel to a pair of the above-mentioned other sides.

Here, although, out of these two neighboring sides, a profile line of one sides is curved and a separation line of the other side is a straight line, the crossing angle spreads in a sector shape at an angle of not less than 90 degrees from a crossing point.

(5) In the above-mentioned constitution (1), the first sides of each protruding portion are formed of portions of circular arcs or elliptical arcs being recessed toward a pair of the above-mentioned one sides and the second side of each protruding portions is formed of a portion of a circular arc or an elliptical arc protruded toward the above-mentioned electron beam aperture.

Here, the first sides and the second side of each protruding portion are respectively curved. Accordingly, the above-mentioned crossing angle is set to not less than 90 degrees and hence, the slipping away of material at the time of punching can be made small thereby the forming of burrs can be reduced.

The mode for carrying out the present invention is explained in detail in conjunction with embodiments shown in attached drawings hereinafter.

Following embodiments are directed to a case in which the present invention is applied to an electron gun adopted by a color cathode ray tube which has a neck diameter of 29 mm and the largest outer diameter of grid electrodes of the electron gun is set to 22 mm. However, the present invention is not limited to the above-mentioned dimensions.

FIG. 1 is an explanatory view of punching to explain the first embodiment of the present invention. FIG. 1 further shows a crossing angle made by a profile of an electrode formed by the first punching (hereinafter called, the first punching) and a punching line (or a cutting line) cut by a subsequent punching (hereinafter called, the second punching). In the drawings, numeral 31 indicates plate-like grid electrodes, numeral 33 indicates connecting portions, numeral 34 indicates the profile lines formed by the first punching, numeral 35 indicates the punching lines (the cutting lines), numeral 36 indicates tubs embedded into bead glass for fixedly securing an electrode, numeral 38 indicates protruding portions formed by cutting the connecting portions 33, L1 indicates a length of a cut portion, and L2 indicates a height of electrode. Three electron beam apertures 30*a*, 30*b*, 30*c* are formed in-line in a longitudinally central portion of each plate-like grid electrode 31. These electron beam apertures are formed simultaneously with punching for forming the profile lines 34.

In a first punching step, the state in which a plurality of electrodes are connected by the connecting portions 33 is obtained. The profile lines 34 are obtained by the first punching step.

Then, In the second punching step, the punching lines 35 are formed such that the punching lines 35 cross the profile lines 34 of portions of the connecting portions 33 at a right angle. Accordingly, an angle $\alpha$ of each crossing portion made by the profile line 34 of the electrode 31 and the punching line 35 is controlled to not less than 70 degrees to not more than 110 degrees.

As previously explained in the explanation of the prior art, when the angle $\alpha$ of the crossing portion is less than 45 degrees or not less than 135 degrees at the time of performing the second punching, burrs are formed. By setting this angle $\alpha$ to 90 degrees as in the case of this embodiment, the slipping away of the material can be reduced and hence, the forming of burrs 38 can be remarkably suppressed. As a result, the burrs removal treatment becomes unnecessary or simple and the manufacturing step can be simplified. Further, products having a high quality can be obtained without carrying out the inspection on all products.

When an electrode having a thickness of 0.7 mm and a crossing angle $\alpha$ of 90 degrees was produced, the mean height of the burrs 38 became not more than 15 $\mu$m. On the other hand, when an electrode (a conventional electrode) having a crossing angle $\alpha$ of 135 degrees was produced, the mean height of the burrs 38 became 30 $\mu$m. Particularly, with respect to electrodes having a thickness of not less than 0.5 mm, the burrs 38 are liable to be formed. Accordingly, it is advantageous to apply the present invention to these electrodes. When a thickness of electrodes exceeds 1.5 mm, the manufacturing of electrodes becomes difficult.

Further, since the cutting length L1 is made shorter than the height L2 of the electrode, even when the second punching is performed on the electrode, the electrode can be formed without giving rise to the deformation of the electron beam apertures 30*c*, 30*a* disposed close to the punching lines 35.

Still further, by controlling the angle $\alpha$ of the crossing portion to not less than 90 degrees and not more than 110 degrees, the electric discharge in the cathode ray tube can be further suppressed.

Figure 2A:
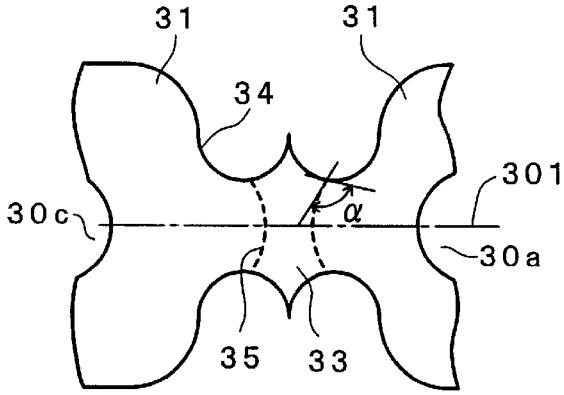
FIG. 2A and FIG. 2B are explanatory views showing the second embodiment of the present invention, wherein a crossing angle between a connecting portion formed by the first punching and a punching line cut and separated by the subsequent punching is indicated.
Figure 2B:
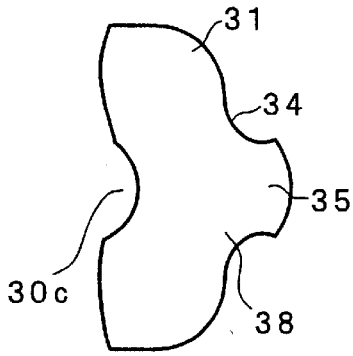

FIG. 2A and FIG. 2B are explanatory views of the punching to explain the second embodiment of the present invention. FIG. 2A shows a profile formed by the first punching and FIG. 2B shows a shape of an electrode formed after performing the second punching. Parts indicated by same symbols used in FIG. 1 correspond to the parts of the first embodiment having the same functions.

According to this embodiment, in the first punching step, a strip-like metal in the state where a plurality of electrodes are connected by means of connecting portions 33 is formed by punching. The connecting portion 33 has projections extending in the directions away from an imaginary center line 301 of the electron beam apertures at a central portion thereof. Profile lines 34 are formed such that they protrude between the projections of the connecting portion 33 and the electrodes 31 in the direction toward the imaginary center line of the electron beam apertures.

Then, in a second punching step, the punching lines 35 are formed such that they are curved toward the connecting portion 33 side in a convex manner. Further, the punching lines 35 are set such that they cross the profile lines 34 at portions of the above-mentioned connecting portions 33 within a range of not less than 70 degrees and not more than 110 degrees. Further, the protruding portions 38 are formed in a sector shape.

By setting this angle a to not less than 70 degrees and not more than 110 degrees ($70° \leqq \alpha \leqq 110°$) as in the case of this embodiment, the slipping away of the material can be reduced and hence, the forming of burrs can be remarkably suppressed. Further, the burr removal treatment becomes unnecessary or simple and products can be obtained without carrying out the inspection on all products.

Figure 3A:
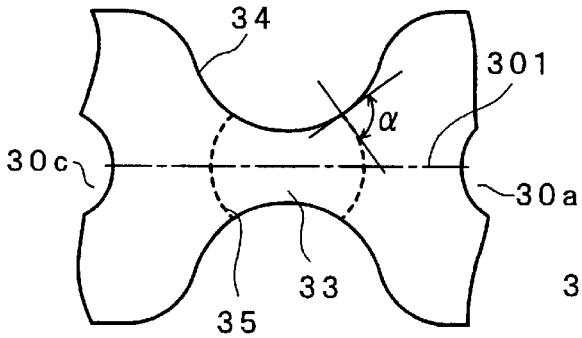
FIG. 3A and FIG. 3B are explanatory views showing the third embodiment of the present invention, wherein a crossing angle between a connecting portion formed by the first punching and a punching line cut and separated by the subsequent punching is indicated.
Figure 3B:
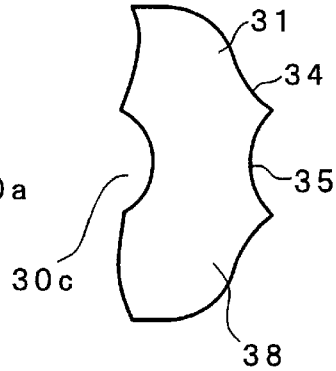

FIG. 3A and FIG. 3B are explanatory views of the punching to explain the third embodiment of the present invention. FIG. 3A shows a profile formed by the first punching and FIG. 3B shows a shape of an electrode formed after performing the second punching. Parts indicated by same symbols used in FIG. 1 correspond to the parts of the first embodiment having the same functions.

According to this embodiment, in the first punching step, a strip-like metal in the state where a plurality of electrodes are connected by means of connecting portions 33 is formed by punching using a press. Profile lines 34 are curved such that they are yielded more as they approach a central portion of the connecting portion 33 through a formed proximal portion of each protruding portion 38. That is, the width between profile lines 34 is made shorter as they approach the center of the connecting portion 33.

Then, in a second punching step, punching lines 35 are formed such that they are curved toward the connecting portion 33 side in a concave manner. That is, a crossing angle a made by the profile line 34 and the punching line 35 is set to not less than 70 degrees and not more than 110 degrees. The second punching is performed along this punching line 35.

By setting this angle α to not less than 70 degrees and not more than 110 degrees as in the case of this embodiment, the slipping away of the material can be reduced and hence, the forming of burrs can be remarkably suppressed. Further, the burr removal treatment becomes unnecessary or simple and products can be obtained without carrying out the inspection on all products.

Figure 4A:
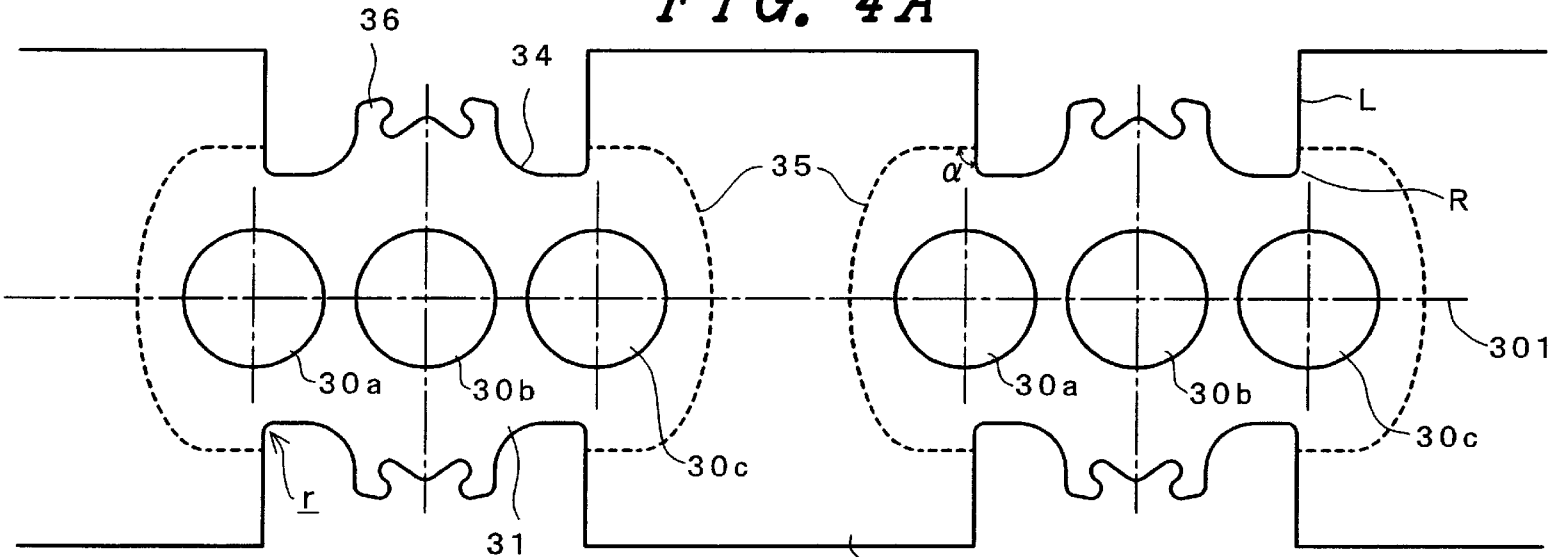
FIG. 4A and FIG. 4B are explanatory views showing the fourth embodiment of the present invention, wherein a crossing angle between a connecting portion formed by the first punching and a punching line cut and separated by the subsequent punching is indicated.
Figure 4B:
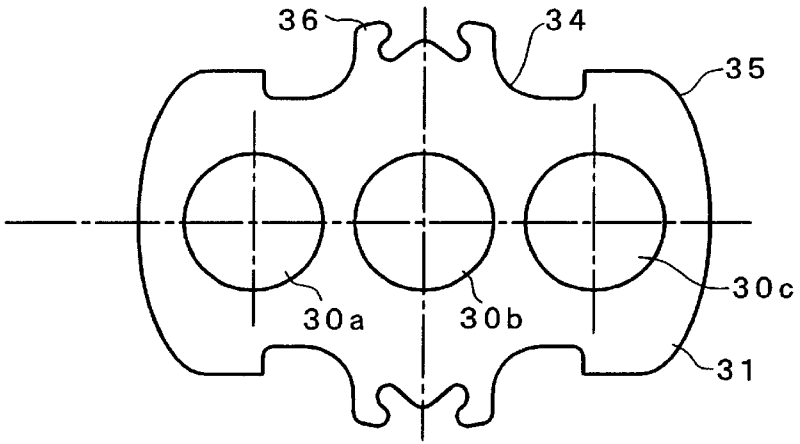

FIG. 4A and FIG. 4B are explanatory views of the punching to explain the fourth embodiment of the present invention. FIG. 4A shows a profile formed by the first punching and FIG. 4B shows a shape of an electrode formed after performing the second punching. Parts indicated by same symbols used in FIG. 1 correspond to the parts of the first embodiment having the same functions.

In FIG. 4A and FIG. 4B, numeral 34 indicates profile lines formed by the first punching and numeral 35 indicates punching lines formed by the second punching.

In the first punching, the profiles adjacent to tabs 36 are formed. The profile in the vicinity of a crossing portion where the profile line 34 crosses the punching line 35 is comprised of a curved portion R having a radius r of curvature and a straight line portion L.

The strip-like metal plate formed by the first punching is punched out along the punching line 35 as shown in FIG. 4B in the second punching.

In the grid electrodes shown in FIG. 4A and FIG. 4B, the crossing portions are formed at upper and lower side portions of the electrode 31.

Since two sides positioned in the in-line direction are disposed close to an inner wall of a neck, they are curved. Accordingly, edges of the electrode can be minimized so that the electric discharge in the inside of the cathode ray tube can be suppressed.

Further, in the second punching, an angle α of the crossing portion made by the profile line 34 of the electrode 31 and the punching line 35 is controlled to not less than 70 degrees and not more than 110 degrees. The angle α of the crossing portion may preferably be not less than 90 degrees and not more than 110 degrees.

According to the electrode of this embodiment, the crossing portions formed by the profile lines 34 and the punching lines 35 are arranged at positions away from the inner wall of the neck. Accordingly, the distance between the neck portion and positions where the burrs 38 are formed can be expanded so that the electric discharge can be suppressed.

Further, according to the present invention, the straight line portions L extend in the direction perpendicular to the center line 301 of the electron beam apertures and the punching lines 35 are arranged in the direction parallel to the center line 301 of the electron beam apertures in the vicinity of the crossing portion. In this manner, by arranging the crossing portions on the straight line portions L, the angle of α of the crossing portions can be controlled to 90 degrees. It is noted that even when the straight line portions L do not extend in the direction perpendicular to the center line 301 or even when the portions of the punching lines 35 in the vicinity of the crossing portions are not arranged parallel to the center lines 301, so long as the angle α of the crossing portions is set to not less than 70 degrees and not more than 110 degrees, the advantageous effect of the present invention can be obtained.

Further, by reducing regions of curved portions R and increasing regions of the straight line portions L, even when the first punching or the second punching is performed at positions displaced from given positions, the angle α of the crossing portions can be surely controlled to not less than 90 degrees and not more than 110 degrees.

Subsequently, a typical structure of an electron gun to which the present invention is applied is explained. The electron gun illustrated hereinafter is merely an example and the present invention is not limited to the electron gun having such a structure. That is, the present invention is also applicable to so-called plate-like grid electrodes, various grid electrodes having similar plate-like electrode components, or other electrodes manufactured by the punching.

Figure 5:
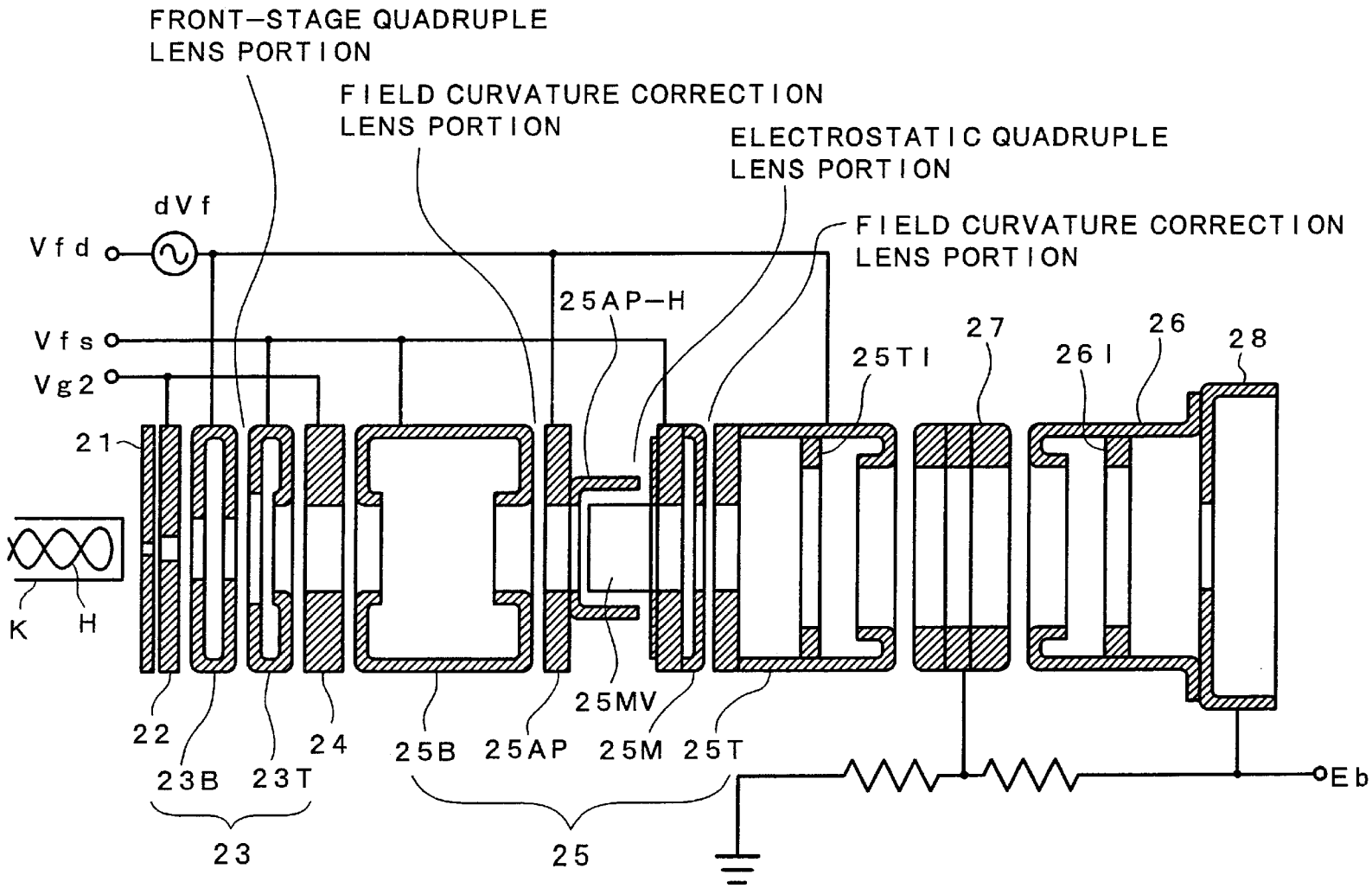
FIG. 5 is a cross-sectional view for explaining the structure of a first example of an electron gun to which the present invention is applied.

FIG. 5 is a cross-sectional view explaining the structure of the first example of the electron gun to which the present invention is applied. That is, FIG. 5 is a cross-sectional view of an in-line type 3 beams electron gun used in a color cathode ray tube taken on a face perpendicular to the in-line array face and taken along a center beam.

This electron gun is comprised of a triode part (an electron beam generating part) which includes a cathode K housing a heater H therein, a plate-like first grid electrode 21 and a plate-like second grid electrode 22, a third grid electrode group 23 which constitutes a front stage quadruple lens portion and includes cylindrical grid electrodes 23B, 23T, a fourth grid electrode 24 made of a thick plate-like grid electrode, a cylindrical grid electrode 25B, cylindrical grid electrodes 25AP, 25M and a cylindrical grid electrode 25T which constitute a fifth grid electrode group 25, an anode 26 and an intermediate grid electrode 27. A shield cup 28 is mounted on a phosphor screen side of the anode 26.

To opposing portions of the cylindrical grid electrodes 25AP, 25M of the fifth grid electrode group, a horizontal plate 25APH and a vertical plate 25MV are fixedly secured and these horizontal plate 25APH and vertical plate 25MV constitute an electrostatic quadruple lens.

Among the grid electrodes of this electron gun, the first grid electrode 21, the second grid electrode 22, the fourth grid electrode 24, portions of the electrodes 25AP, 25M and a portion of the electrode 25T of the fifth grid electrode group 25, an inner electrode 25TI of the electrode group 25, and an inner electrode 26I of the anode 26 are respectively constituted by plate-like grid electrodes.

In the electron gun having such a constitution, an accelerating voltage Vg2 is supplied to the second grid electrode 22 and the fourth grid electrode 24. A focus voltage Vfs of a constant value is supplied to the top electrode 23T which constitutes one of the third grid electrode group 23 and the bottom electrode 25B and the intermediate electrode 25M of the fifth grid electrode group 25. A dynamic focus voltage which is produced by superposing a dynamic voltage dVf to a constant voltage Vfd is supplied to the bottom electrode 23B of the third grid electrode group 23 and the aperture electrode 25AP and the top electrode 25T of the fifth grid electrode group 25. In FIG. 5, symbol Eb indicates an anode voltage and a voltage produced by dividing the anode voltage Eb by resistance is applied to the intermediate electrode 27.

In the electron gun having such a constitution, a front stage electrostatic quadruple lens is formed by the electrodes 23B, 23T which constitute the third grid electrode group 23, while an electrostatic quadruple lens is formed by the aperture electrode 25AP and the intermediate electrode 25M of the fifth grid electrode group 25.

Although the present invention is applicable to all of the above-mentioned plate-like grid electrodes, the present invention is particularly advantageous when applied to the punching of fourth plate-like grid electrode 24 having a large thickness.

Figure 6:
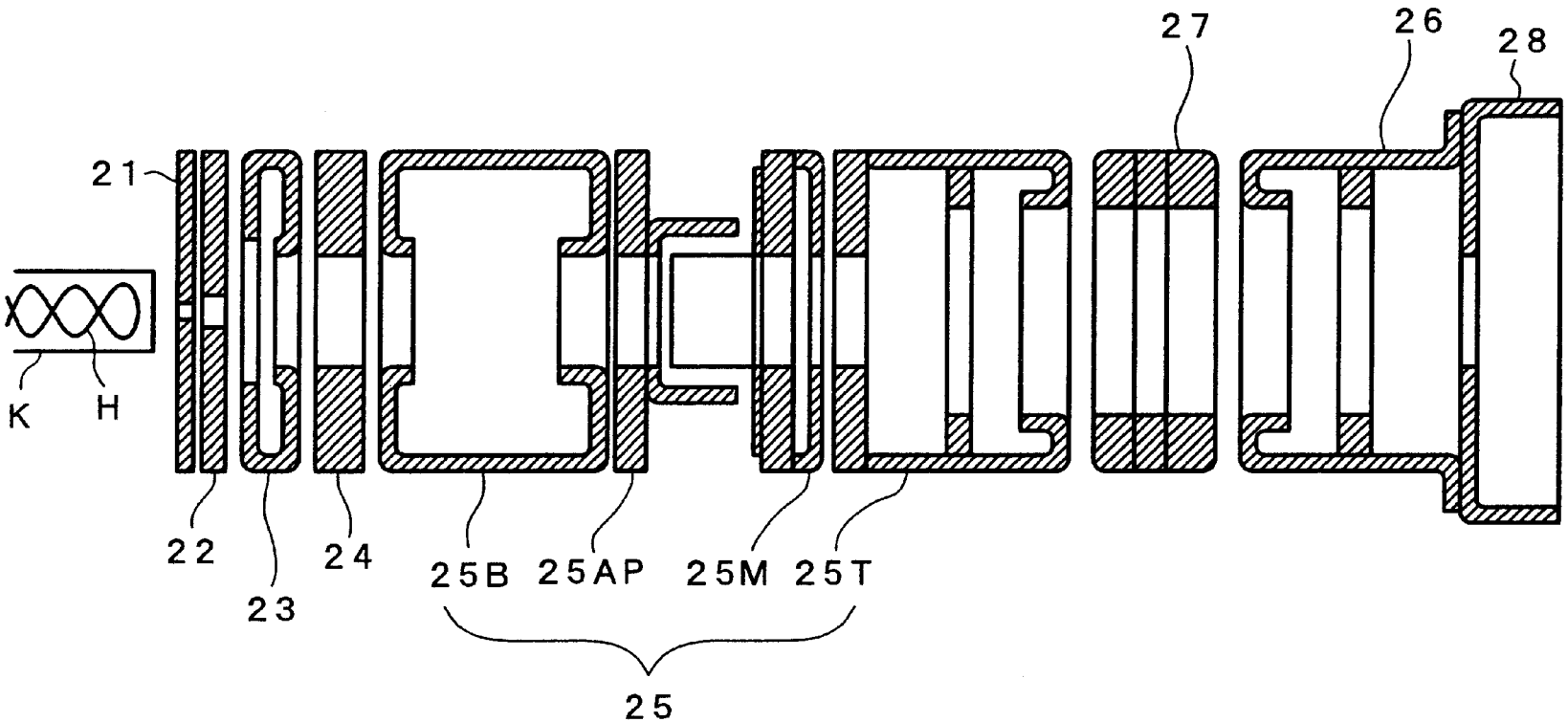
FIG. 6 is a cross-sectional view for explaining the structure of a second example of an electron gun to which the present invention is applied.

FIG. 6 is a cross-sectional view explaining the structure of a second example of the electron gun to which the present invention is applied. That is, FIG. 6 is a cross-sectional view of an in-line type 3 beams electron gun used in a color cathode ray tube taken on a face perpendicular to the in-line array face and taken along a center beam.

This electron gun substantially has the same constitution as that of the electron gun shown in FIG. 5 except for that the third grid electrode group 23 shown in FIG. 5 is formed of a single cylindrical grid electrode thus eliminating the front stage quadruple lens. With respect to this electron gun, the present invention is also applicable to all of the above-mentioned plate-like grid electrodes and is particularly advantageous in punching of the fourth plate-like grid electrode 24 having a large thickness.

Figure 7:
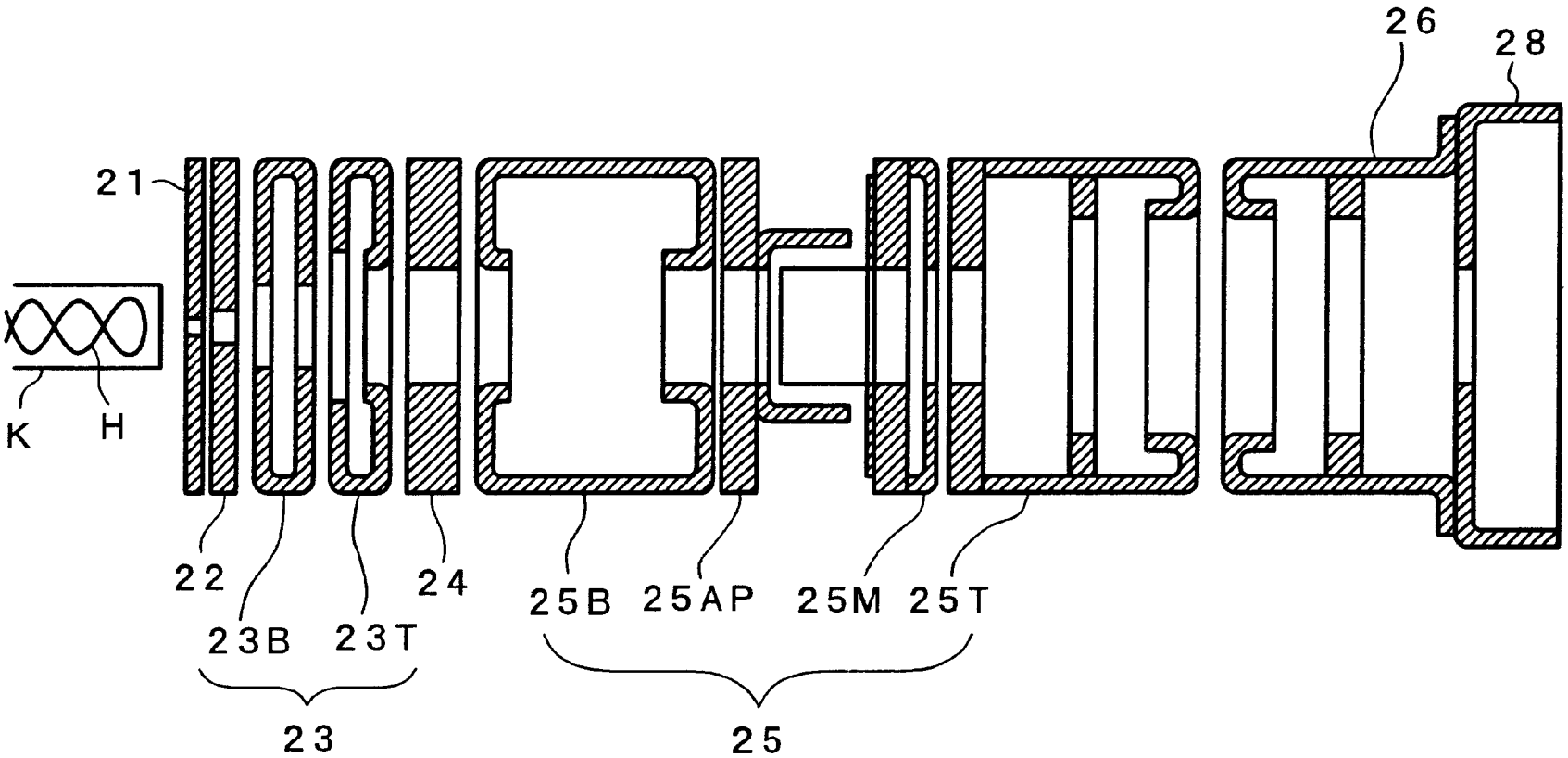
FIG. 7 is a cross-sectional view for explaining the structure of a third example of an electron gun to which the present invention is applied.

FIG. 7 is a cross-sectional view explaining the structure of a third example of the electron gun to which the present invention is applied. That is, FIG. 7 is a cross-sectional view of an in-line type 3 beams electron gun used in a color cathode ray tube taken on a face perpendicular to the in-line array face and taken along a center beam.

This electron gun substantially has the same constitution as that of the electron gun shown in FIG. 5 except for that the intermediate grid electrode group 27 shown in FIG. 5 is eliminated. With respect to this electron gun, the present invention is also applicable to all of the above-mentioned plate-like grid electrodes and is particularly advantageous in punching of the fourth plate-like grid electrode 24 having a large thickness.

Figure 8:
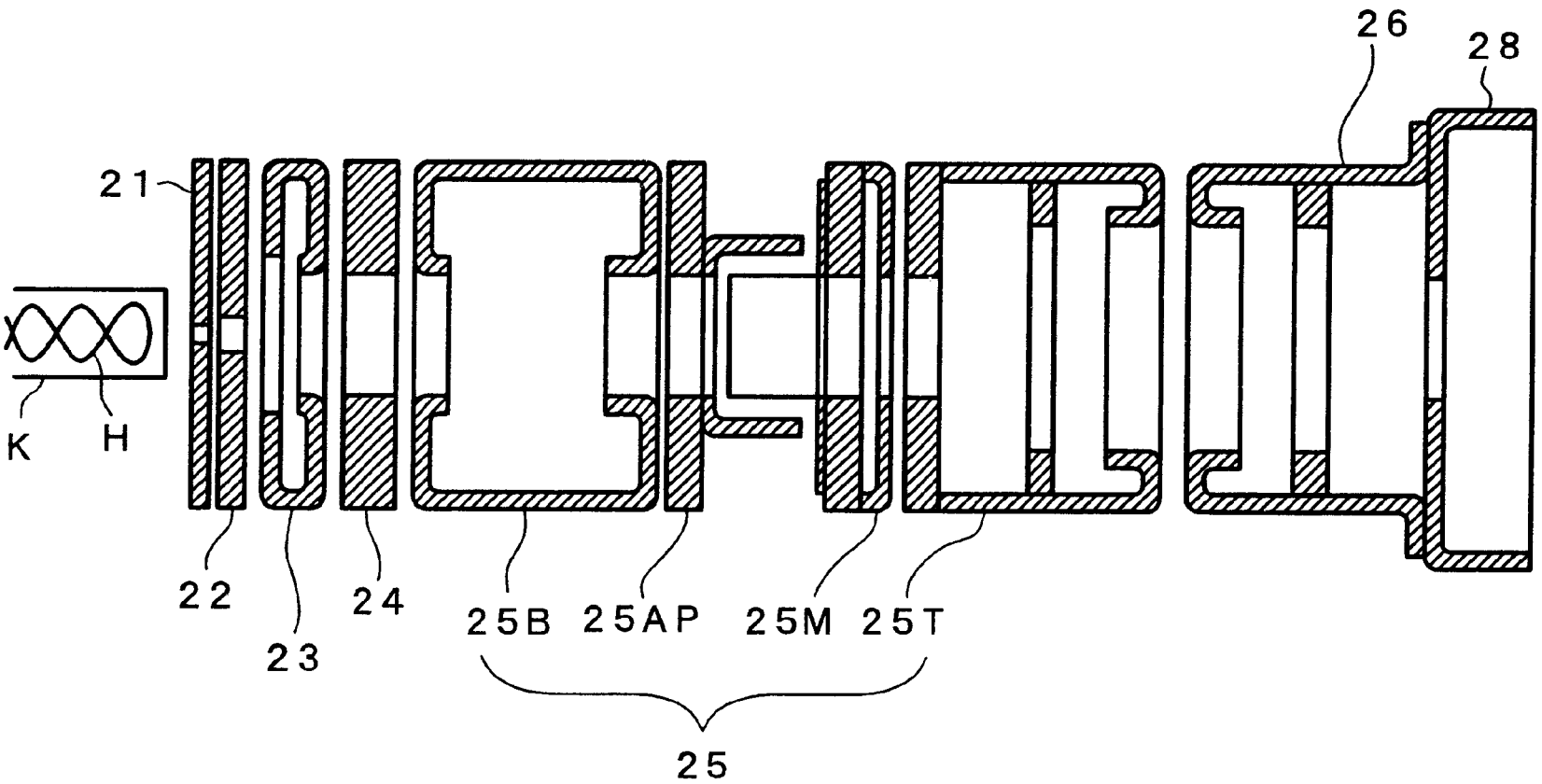
FIG. 8 is a cross-sectional view for explaining the structure of a fourth example of an electron gun to which the present invention is applied.

FIG. 8 is a cross-sectional view explaining the structure of a fourth example of the electron gun to which the present invention is applied. That is, FIG. 8 is a cross-sectional view of an in-line type 3 beams electron gun used in a color cathode ray tube taken on a face perpendicular to the in-line array face and taken along a center beam.

This electron gun substantially has the same constitution as that of the electron gun shown in FIG. 5 except for that the third grid electrode group 23 shown in FIG. 5 is formed of a single cylindrical grid electrode thus eliminating the front stage quadruple lens and that the intermediate grid electrode group 27 is eliminated. With respect to this electron gun, the present invention is also applicable to all of the above-mentioned plate-like grid electrodes and is particularly advantageous in punching of the fourth plate-like grid electrode 24 having a large thickness.

Figure 9:
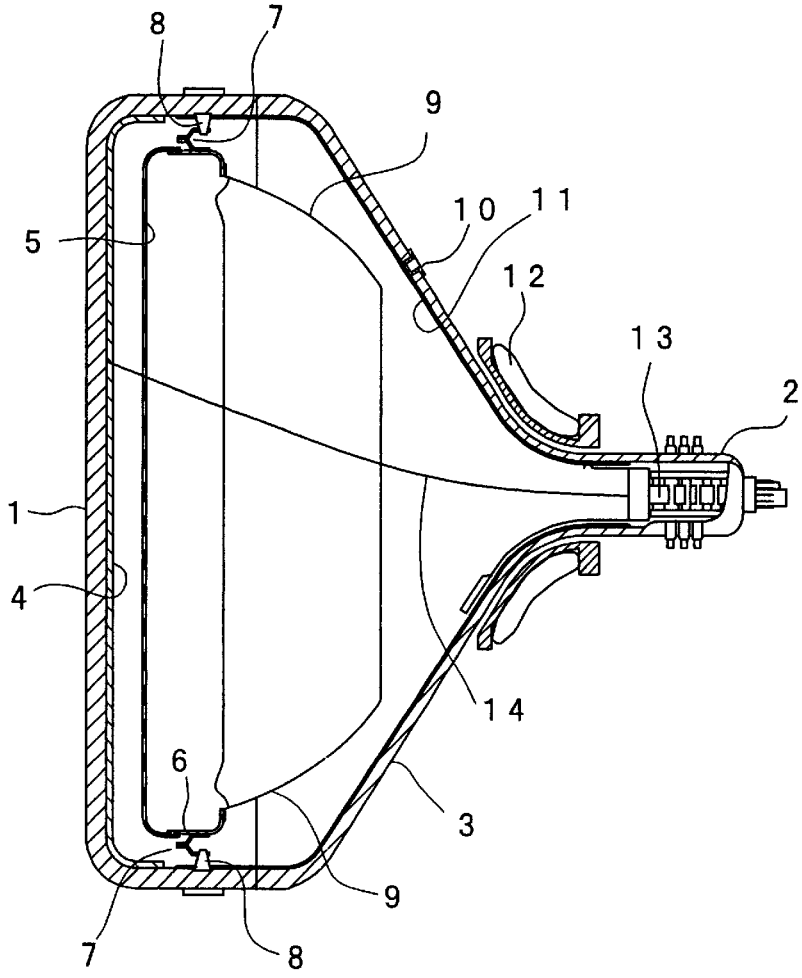
FIG. 9 is a cross-sectional view for explaining a structural example of an in-line type color cathode ray tube which is a typical example of the cathode ray tube of the present invention.
Figure 10:
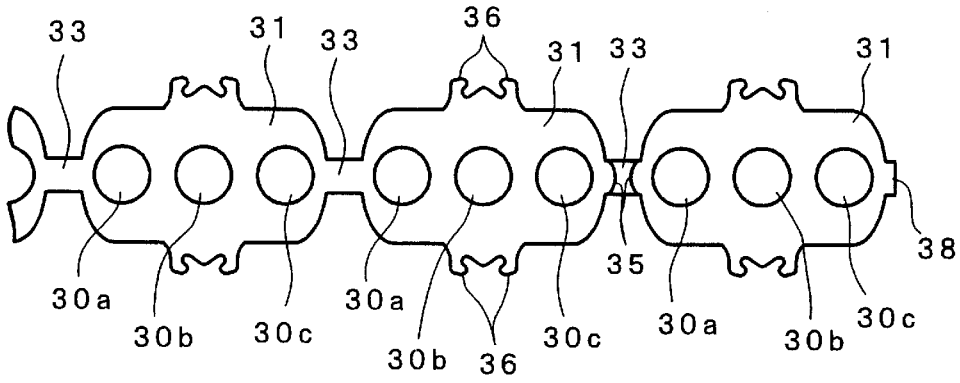
FIG. 10 is an explanatory view showing a state where same kind of plate-like grid electrodes which constitute an electron gun are formed as a group by the first punching.
Figure 11:
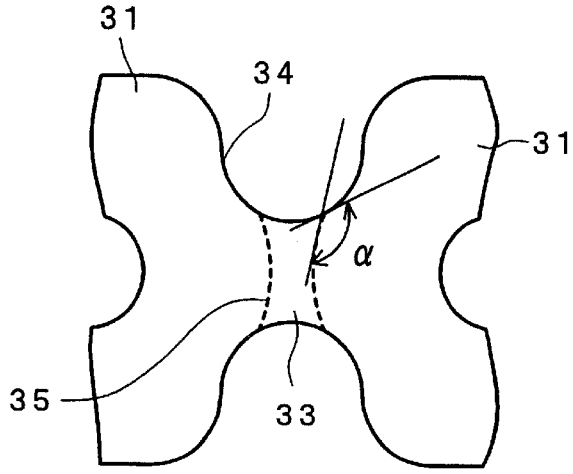
FIG. 11 is an explanatory view for explaining a crossing angle made by a connecting portion formed by the first punching and a punching line formed by performing the subsequent punching in a conventional punching working.
Figure 12A:
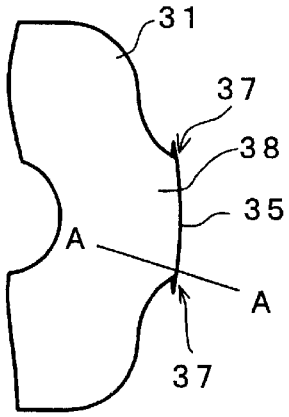
FIG. 12A to FIG. 12C are partial views for explaining the states of protruding portions of plate-like grid electrodes after removing connecting portions by the subsequent punching in the conventional punching.
Figure 12B:
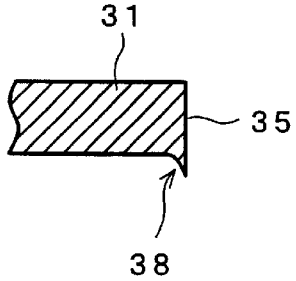
Figure 12C:
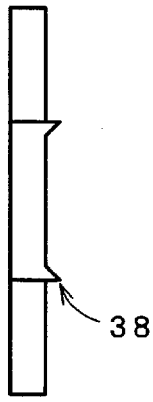

FIG. 9 is a cross-sectional view for explaining a structural example of an in-line type color cathode ray tube which constitutes a typical example of a cathode ray tube of the present invention. This color cathode ray tube is comprised of an evacuated envelope which includes a panel portion 1 constituting a phosphor screen 4, a neck portion 2 storing an electron gun 13 and a funnel portion 3 which connects the panel portion 1 and the neck portion 2.

A deflection yoke 12 is mounted on an exterior of a neck portion 2 side of the funnel portion 3. Further, in the inside of the panel portion 1, a shadow mask 5 which constitutes a color selection electrode is disposed close to the phosphor screen 4 and is supported by an inside wall of the panel portion 1 in a suspended manner. The shadow mask 5 has one end thereof extended in one direction and fixedly secured to a mask frame 6 and the other end suspended by studs 8 embedded into the inside wall of the panel portion 1. Further, a magnetic shield 9 is fixedly secured to the mask frame 6.

An interior conductive film 11 is coated on the inside wall of the funnel portion 3 and a high voltage (an anode voltage Eb) which is supplied to an anode button 10 formed on a tube wall in a penetrating manner is applied to an anode of the electron gun 13 and the phosphor screen 4.

The electron gun 13 stored in the neck portion 2 irradiates in-line three electron beams Bc, Bs×2 approximately in parallel to each other on one horizontal plate toward a phosphor screen 16 and these electron beams are selected by the shadow mask 5 and then impinge on the respective phosphor bodies and form given color pixels thus reproducing color images.

This color cathode ray tube is provided with the electron gun having plate-like grid electrodes explained in the above embodiments as an electron gun.

In the above-mentioned respective embodiments, although the invention has been explained in view of the color cathode ray tube having the in-line type electron gun which irradiates three electron beams as an example, the present invention is also applicable in the similar manner to plate-like grid electrodes which constitute an electron gun of a cathode ray tube which adopts a single electron beam.

The present invention is not limited to the constitutions of the above-mentioned respective embodiments and various modifications are conceivable without departing from the technical concept of the present invention.

Further, although the angle $\alpha$ of the crossing portion is set to not less than 70 degrees and not more than 110 degrees in the above-mentioned respective embodiments, by setting the angle $\alpha$ of the crossing portion to not less than 90 degrees and not more than 110 degrees, the electric discharge inside the cathode ray tube can be further suppressed.

Further, the profile of the electrode is completed by performing the punching twice in the above-mentioned respective embodiments, the present invention is applicable to a case in which the profile of the electrode is completed by performing the punching three times or more.

As has been explained heretofore, the present invention can reduce the forming of burrs in the punching of the plate-like grid electrodes which constitute the electron gun. Accordingly, the present invention can obtain following advantageous effects. That is, the present invention can facilitate the assembling of the electron gun, can increase the withstand voltage characteristics and can provide a color cathode ray tube having a high quality and a high reliability.

What is claimed is:

1. A cathode ray tube including a panel portion having a phosphor screen formed thereon, a neck portion housing an electron gun, and a funnel portion connecting said panel portion and said neck portion, wherein said electron gun arranges a cathode, grid electrodes and an anode along a tube axis of said cathode ray tube, said grid electrodes have profiles thereof formed by working including a first punching and a second punching, and an angle of crossing portions formed by said first punching and said second punching is set to not less than 70 degrees and not more than 110 degrees.

2. A cathode ray tube according to claim 1, wherein said angle of said crossing portions is set to not less than 90 degrees and not more than 110 degrees.

3. A cathode ray tube according to claim 1, wherein said plate-like grid electrodes have an approximately rectangular planar shape, said plate-like grid electrodes have tabs to be embedded into beading glass formed on pair of one opposing sides, and said crossing portions are formed on said sides having said tabs.

4. A cathode ray tube according to claim 1, wherein said plate-like grid electrodes have an approximately rectangular planar shape, said plate-like grid electrodes have tabs to be embedded into beading glass formed on a pair of one opposing sides, a pair of the other opposing sides are made of curved lines, and said crossing portions are formed on a pair of said the other opposing sides.

5. A cathode ray tube according to claim 1, wherein a thickness of said plate-like grid electrode is 0.5–1.5 mm.

6. A method for manufacturing a color cathode ray tube having a panel portion having a phosphor screen formed thereon, a neck portion housing an electron gun, and a funnel portion connecting said panel portion and said neck portion, wherein electrodes of said electron gun have profiles thereof formed by steps including a first punching step and a second punching step, and said second punching step performs punching by setting an angle of a crossing portion of electrode side against said first punching step to not less than 70 degrees and not more than 110 degrees.

* * * * *